US006271756B1

(12) United States Patent
Davies, Jr. et al.

(10) Patent No.: US 6,271,756 B1
(45) Date of Patent: Aug. 7, 2001

(54) SECURITY TAG DETECTION AND LOCALIZATION SYSTEM

(75) Inventors: John E. Davies, Jr., Sewell, NJ (US); Eric A. Eckstein, Merion Station, PA (US); Edwin H. Hopton, Jr., Philadelphia, PA (US); William S. Richie, Jr., Pennsville, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

(21) Appl. No.: 09/472,395

(22) Filed: Dec. 27, 1999

(51) Int. Cl.[7] ..... G08B 13/14

(52) U.S. Cl. ..... 340/572.7; 340/568.1; 340/572.1

(58) Field of Search ..... 340/572.1, 572.4, 340/572.7, 568.1, 571, 928, 825.31, 825.35; 343/867, 761, 762

(56) References Cited

U.S. PATENT DOCUMENTS

| | | | | |
|---|---|---|---|---|
| 4,308,530 | | 12/1981 | Kip et al. | 340/572.2 |
| 5,051,726 | * | 9/1991 | Copeland et al. | 340/572.7 |
| 5,103,234 | * | 4/1992 | Watkins et al. | 340/572.7 |
| 5,648,767 | * | 7/1997 | O'Connor et al. | 340/928 |
| 5,661,457 | * | 8/1997 | Ghaffari et al. | 340/572.7 |
| 5,708,423 | * | 1/1998 | Ghaffari et al. | 340/572.4 |
| 5,815,076 | * | 9/1998 | Herring | 340/572.5 |
| 6,094,173 | * | 7/2000 | Nylander | 340/572.7 |

* cited by examiner

*Primary Examiner*—Van T. Trieu
(74) *Attorney, Agent, or Firm*—Akin, Gump, Strauss, Hauer & Feld, L.L.P.

(57) ABSTRACT

A security tag detection and localization system for detecting a resonant security tag in a security zone comprising a Plurality of detection zones, and generating an alarm signal localizing the resonant security tag to a detection zone. The system includes an antenna array for radiating interrogation signals and receiving response signals. The antenna array forms the upper boundary, the lower boundary or both the upper and lower boundaries of a security zone and extends horizontally across the width and length of the security zone. The antenna array comprises at least two antennas. The antennas forming the upper and lower boundaries are disposed side-by-side in a single horizontal plane with each antenna being electromagnetically coupled to one of the detection zones. The security tag detection and localization system also includes one or more electronic article security (EAS) sensors for transmitting interrogation signals to the antenna array, receiving response signals from the antenna array, and generating an alarm signal. The security tag detection and localization system also includes an annunciator connected to each EAS sensor, for receiving the alarm signal and indicating a detection zone corresponding to the alarm signal.

21 Claims, 5 Drawing Sheets

SECURITY TAG DETECTION AND LOCALIZATION SYSTEM

BACKGROUND OF THE INVENTION

The present invention relates generally to electronic article security (EAS) systems for detecting the presence of a security tag within a security zone and more particularly to an improved electronic article security system having the capability for localizing a resonant security tag within a portion of the security zone.

The use of electronic article security systems for detecting and preventing theft or unauthorized removal of articles or goods from retail establishments and/or other facilities such as libraries has become widespread. In general, such EAS systems employ a security tag, which is detectable by the EAS system and which is secured to the article to be protected. Such EAS systems are generally located at or around points of exit irom such facilities to detect the security tag, and thus the article, as it transits through the exit point.

Due to environmental and regulatory considerations, individual EAS systems are generally effective over only a limited area in which a security tag attached to a protected article may be reliably detected. Such area, typically referred to as a security zone, is generally limited to about six feet in width for a single EAS system. While many stores and libraries have only a single exit doorway of a size commensurate with such a six foot wide security zone, many other retail establishments have eight or ten exit doorways arranged side by side. Furthermore, large mall stores frequently have a generally wide open area or aisle of ten feet or more in width serving as a connection with the mall. Thus, in many such situations, a plurality of EAS systems are required to fully protect exit/entrance points having a width greater than that which can be reliably protected by a single EAS system.

In a large mall entryway that needs to be protected, it is likely that the store owner will not want to employ a traditional EAS system installation which would include multiple, large, side-side "pedestal" antenna structures, due to aesthetic visual or marketing reasons. Such store owners would prefer an "invisible" EAS system in which the EAS antenna structure is mounted in the floor beneath the entryway, hung over the entryway or both. Such EAS systems usually provide adequate detection of tagged merchandise transiting through the security zone but fail to provide a localization of a detection to a specific portion of the security zone. Thus, when many customers are in proximity of the entryway when an alarm is activated, store personnel generally have no way, other than trial and error, to determine which customer has set off an alarm with the tagged merchandise. This leads to either a lack of use of the EAS system as an effective security aid, or the owner having disgruntled customers who take their business elsewhere.

The present invention overcomes the problem of an "invisible" EAS system not being able to localize a tag detection to a specific portion of the security zone in a large entryway by utilizing a plurality of EAS sensors of the pulse-listen type, in combination with a plurality of antennas placed either above or below the entryway. The resulting EAS system determines the relative proximity of a detected security tag transiting through the security zone to each of the plurality of antennas in the array. The resulting EAS system achieves localization of a security tag to within a small portion of the security zone.

BRIEF SUMMARY OF THE INVENTION

Briefly stated the present invention provides a security tag detection and localization system for detecting a resonant security tag in a security zone comprising a plurality of detection zones, and generating an alarm signal localizing the resonant security tag to a detection zone. The system comprises: an antenna array for radiating interrogation signals and receiving response signals, the antenna array forming at least one of an upper and a lower boundary of the security zone and being arranged horizontally across a width and a length of the security zone, wherein the antenna array comprises at least two antennas, the antennas forming one of the upper and lower boundaries being disposed side-by-side in a single horizontal plane, each antenna being electromagnetically coupled to one of the detection zones; at least one electronic article security (EAS) sensor for transmitting interrogation signals to the antenna array, receiving response signals from the antenna array and generating an alarm signal; and an annunciator connected to each EAS sensor, for receiving the alarm signal and indicating a detection zone corresponding to the alarm.

In accordance with another aspect of the present invention there is an EAS sensor of the pulse-listen type for detecting and localizing a resonant security tag to a specific portion of a security zone comprising: a transmitter for generating an interrogation signal; a receiver for receiving a response signal from the security tag; a plurality of transmitting antennas for receiving the interrogation signal from the transmitter and radiating the interrogation signal into the security zone; a plurality of receiving antennas for receiving the response signal from the security tag and providing the response signal to the receiver, the response signal being a result of the interrogation signal interacting with the security tag and being re-radiated from the security tag; and an antenna switch connecting the transmitter to the transmitting antennas and the receiver to the receiving antennas, the antenna switch sequentially selecting pair-wise permutations, with replacement, of the antennas once over a predetermined time interval, such that each selected pair consists of one transmitting antenna and one receiving antenna, wherein an amplitude of an output from the receiver resulting from each permutation of the antennas is compared, thereby determining the location of the security tag to correspond with the portion of the security zone being in closest proximity to the antenna pair having the receiver output signal with the largest amplitude.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
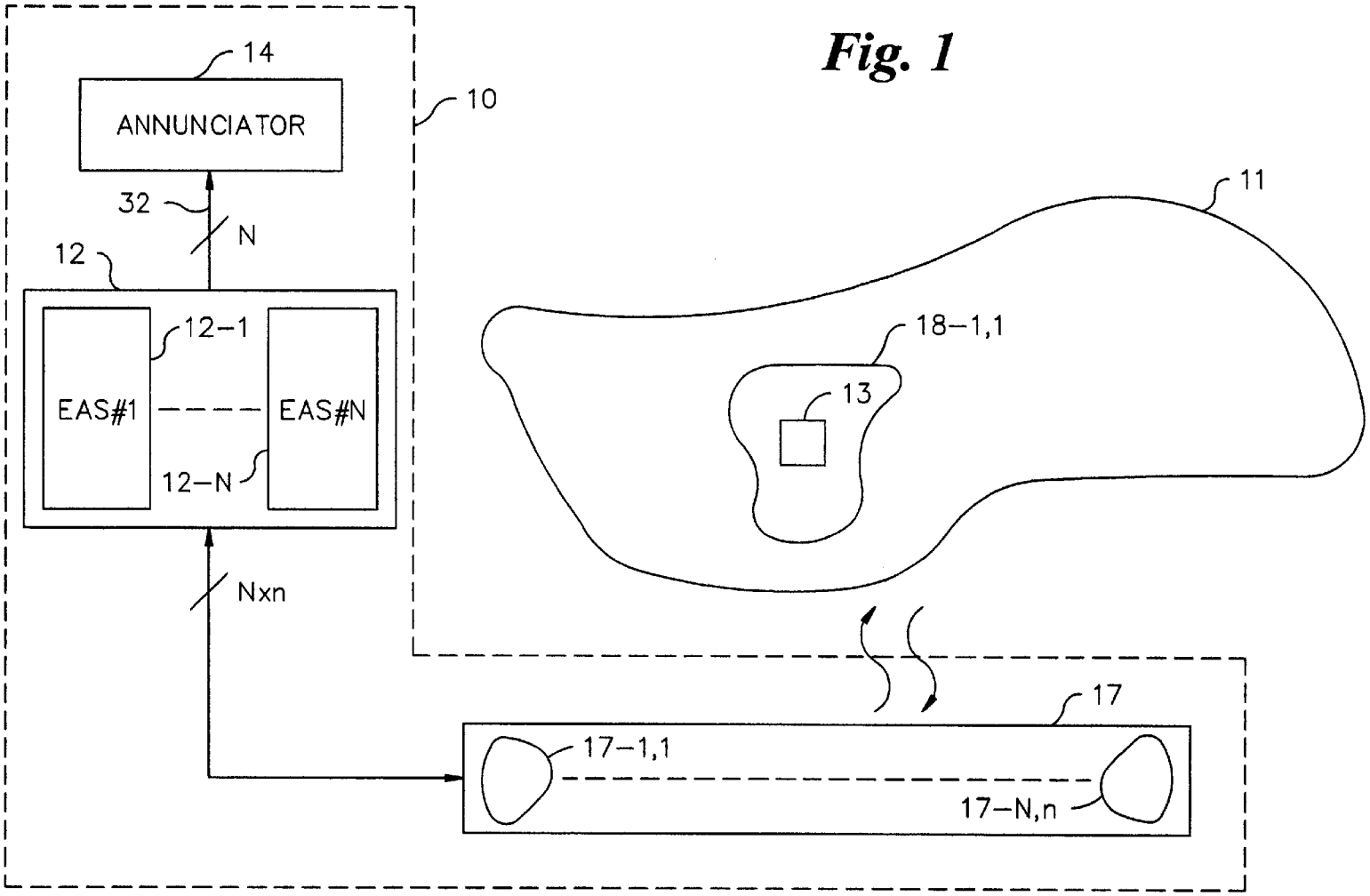
FIG. 1 is a functional block diagram of a security tag detection and localization system/according to a preferred embodiment of the present invention.

Referring to the drawings, where like numerals are used to indicate like elements throughout, there is shown in FIG. 1 a functional block diagram of a security tag detection and localization system 10 for detecting a resonant security tag 13 in a security zone 11 comprising a plurality of detection zones 18 (not shown) one of which is shown as 18-1,1 and localizing the resonant security tag 13 to one or more of the detection zones 18. The tag detection and localization system 10 comprises from one to N EAS sensors 12, shown individually as 12-1 through 12-N; an antenna array 17 comprising from one to n individual antennas connected to each EAS sensor 12, shown individually as 17-1,1 through 17-N, n; and an annunciator 14.

The security tag 13 is of a type which is well known in the art of EAS systems having a resonant frequency vithin the frequency range of the EAS detection and localization system 10 with which the tag 13 is employed. Preferably, the tag 13 has a circuit Q of between 50 and 100 and resonates at or near a frequency of 8.2 MHz., which is a resonant frequency commonly employed by EAS systems from a number of manufacturers. Typically, the resonant frequency of a security tag 13 has a tolerance of +/−10%, thus requiring each EAS sensor 12 to operate over a range of about 7.6 to 8.7 MHz. However, a security tag 13 having a resonant frequency of about 8.2 MHz. is not to be considered a limitation of the present invention. As will be appreciated by those skilled in the art, the security tag detection and localization system 10 is suitable for operating at any frequency for which the security tag detection and localization system 10 is capable of establishing a suitable electromagnetic interaction between the antenna array 17 and the security tag 13.

The antenna array 17 forms either the upper boundary of the security zone 11, the lower boundary of the security zone 11, or the antenna array 17 may be apportioned to both the upper and lower boundaries of the security zone 11. In the preferred embodiment, the full horizontal extent of the combined upper and lower portions of the antenna array defines the approximate width and the approximate length of the security zone 11. When forming the lower boundary of the security zone 11, the antenna array 17 is generally made integral with the floor. As will be appreciated by one skilled in the art, the antenna array 17 could also be mounted beneath the floor or mounted above the surface of the floor. When the array of antennas 17 is located above the security zone 11, it may be concealed in a ceiling or suspended beneath the ceiling, within the spirit and scope of the invention.

The antenna array 17 comprises at least two antennas, the antennas 17 comprising each of the upper and the lower boundaries being disposed side-by side in a single horizontal plane. In the antenna array 17 each individual antenna 17-1,1, 17-N, n, is electromagnetically coupled to one of the detection zones 18. Thus, because of the side-by-side configuration of the individual antennas 17-1,1, 17-N, n, the beams of the individual antennas 17-1,1, 17-N, n, illuminate adjoining detection zones 18, which may also overlap, depending on the specific shape of the beams of the individual antennas 17.

In the preferred embodiment the antennas 17 are combined transmitting and receiving loop-type antennas of a kind which do not create a null in the far field of the major beam of the antenna and are of a conventional design well known to those skilled in the art. As will be appreciated by those skilled in the art, it is not required to use the same antenna 17 for transmitting and receiving. Separate transmitting and receiving antennas 17 could be used, within the spirit and scope of the invention. Further, the type of antenna 17 is not limited to a non-nulling loop-type antenna. Any type of antenna 17 having a beam shape commensurate with the desired size and shape of the detection zones 18 is within the spirit and scope of the invention.

The security tag detection and localization system 10 also includes one or more electronic article security (EAS) sensors 12 for transmitting interrogation signals to the antenna array 17, receiving response signals from the antenna array 17 and generating an alarm signal localizing the security tag 13 to a detection zone 18.

Figure 2:
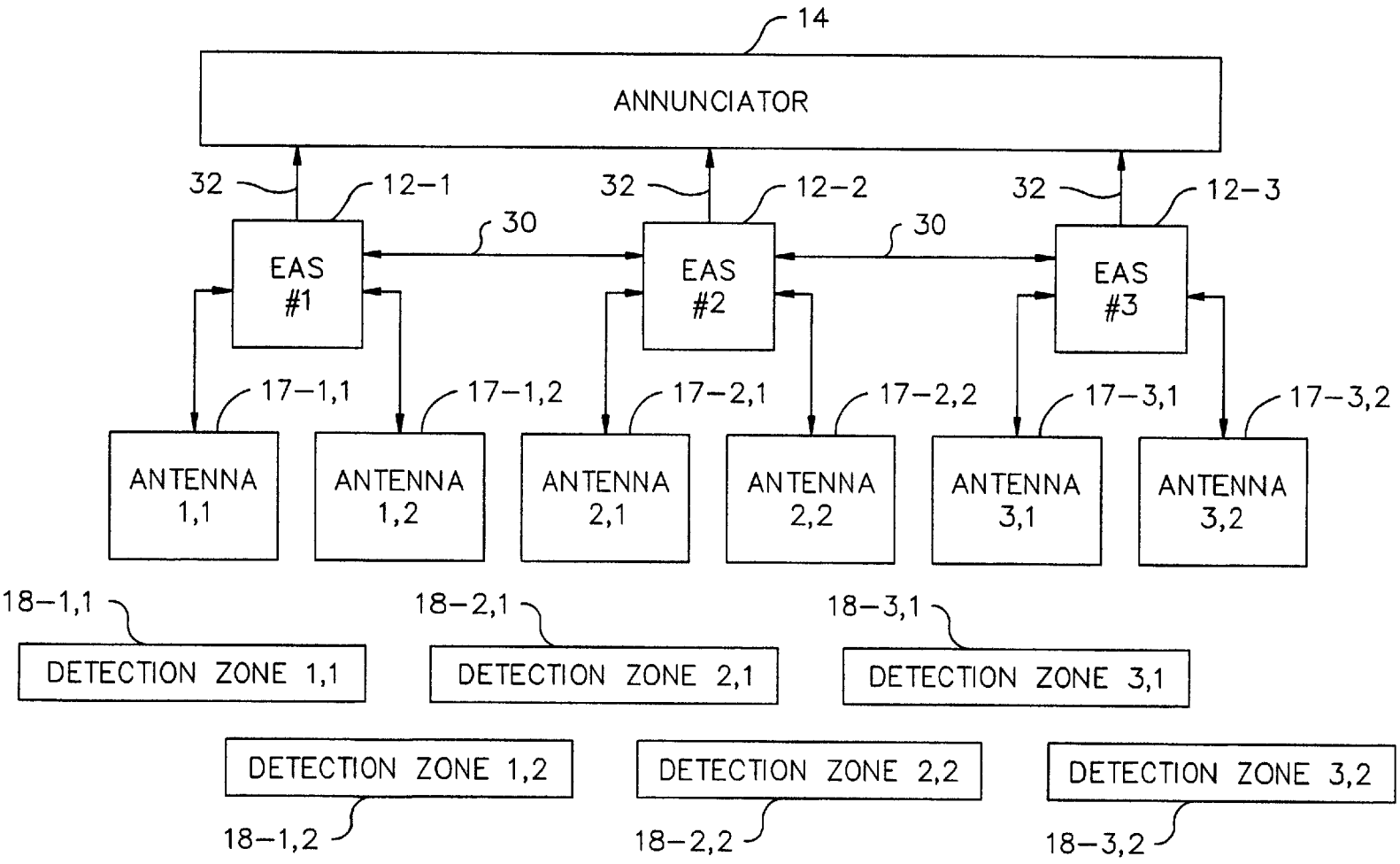
FIG. 2 is a more detailed functional block diagram of the preferred embodiment of the present invention.

Referring now to FIG. 2 there is shown a preferred embodiment having three EAS sensors 12-1, 12-2 and 12-3, each of which is connected to two antennas 17-1,1, 17-1,2; 17-2, 1, 17-2,2; and 17-3,1, 17-3,2. Also shown are the detection zones 18-1,1, 18-1,2; 18-2,1, 18-2,2; and 18-3,1, 18-3,2, corresponding to the antennas 17-1,1, 17-1,2; 17-2,1, 17-2,2; and 17-3,1, 17-3,2. In the preferred embodiment, the detection zones 18 of adjoining antennas 17 overlap, giving rise to an alarm signal on signal lines 32 which may correspond to a single detection zone 18 or to adjoining detection zones 18. In the latter case, the annunciator 14 localizes a security tag 13 to more than one detection zone 18. Also shown in FIG. 2 is a slave signal line 30 for synchronizing the separate EAS sensors 12, as discussed in more detail below. As will be appreciated by those skilled in the art, the number of EAS sensors 12 that could be included in a single security tag detection and localization system 10 is not limited to three and may be greater or less than three. Also, the number of antennas 17 which could be connected to each EAS sensor 12 is not limited to two and could be greater or less than two, and still be within the spirit and scope of the invention.

The electronic article security sensor 12 further includes an annunciator 14 connected to each EAS sensor 12, for receiving the alarm signal over alarm signal lines 32 and for indicating the detection zone 18 corresponding to the alarm signal. In the preferred embodiment, the annunciator 14 is a series of lamps (not shown), each lamp uniquely associated with a single detection zone 18 and emitting visible light when a security tag 13 is detected and localized to a detection zone 18 corresponding to the lamp. As will be appreciated by those skilled in the art, the method of annunciation provided by annunciator 14 is not limited to visual annunciation. Other methods for annunciation could be used including, but not limited to, a combined audio and visual display, or a TV type display, within the spirit and scope of the invention.

Figure 3:
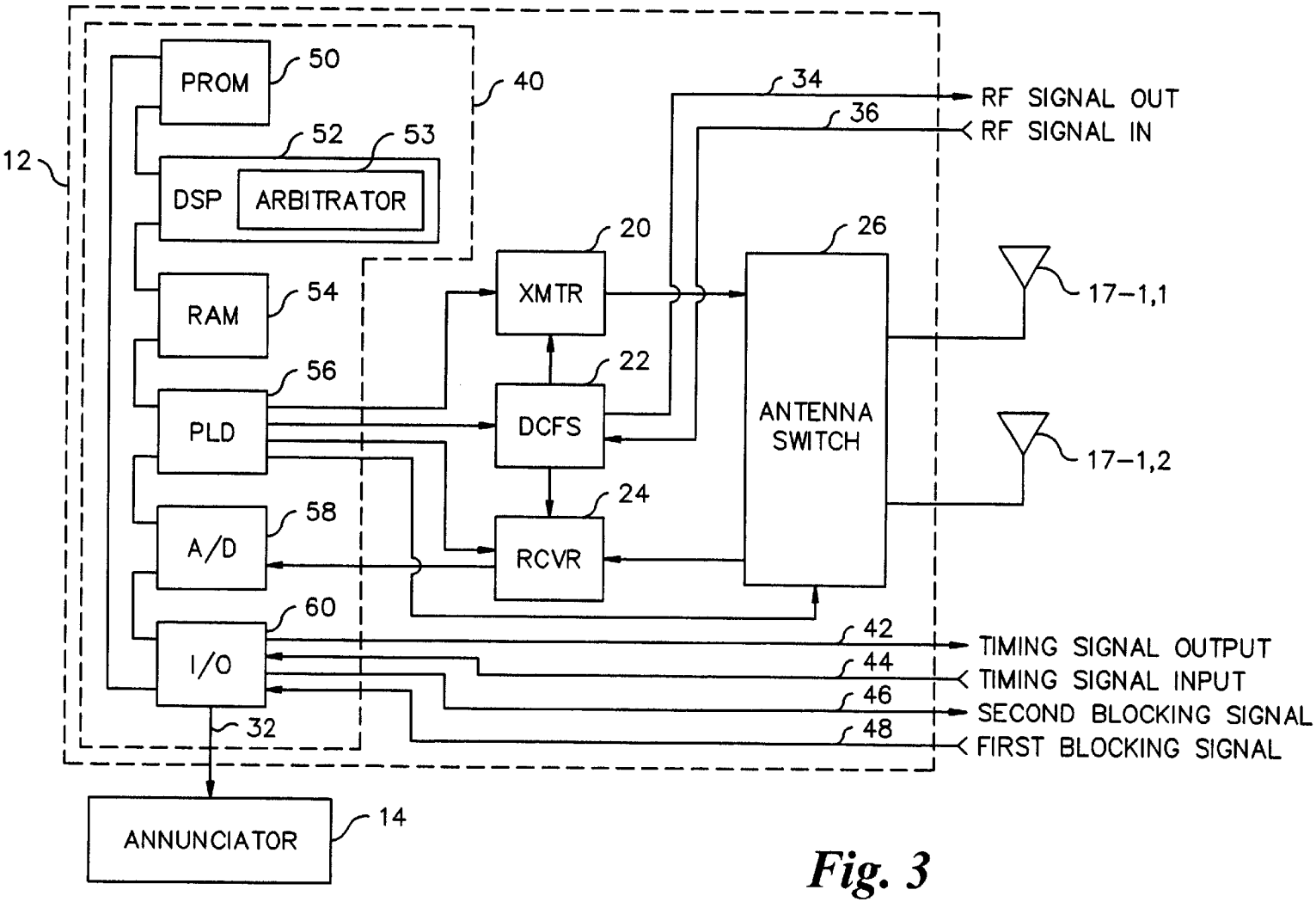
FIG. 3 is a functional block diagram of an electronic article security (EAS) sensor.

Referring now to FIG. 3, the preferred embodiment of the EAS sensor 12-1, representative of the EAS sensors 12, comprises a transmitter 20 for generating an interrogation signal and providing the interrogation signal to an antenna switch 26, and a receiver 24, synchronized with the transmitter 20, for receiving a response signal from the antenna switch 26 and generating an output signal. The EAS sensor 12-1 further includes antennas 17-1,1 and 17-1,2 for receiving the interrogation signal from the antenna switch 26 and radiating the interrogation signal into the security zone 11, and receiving the response signal re-radiated from a security tag 13 located in one of the detection zones 18 and providing the response signal to the receiver 24. The EAS sensor 12-1 also includes the antenna switch 26, connecting each EAS sensor 12 to the antennas 17-1,1 and 17-1,2 and a digitally controlled frequency synthesizer (DCFS) 22 for providing a carrier output signal which tunes the transmitter 20 to a transmitting frequencv and tunes the receiver 22 to a receiving frequency. The transmitter 20, the DCFS 22, the receiver 24 and the antenna switch 26 are conventional in design and well known to those skilled in the art, and therefore need not be described in detail for a complete understanding of the present invention.

The preferred embodiment also includes a controller 40 for setting the frequency of the carrier output signals generated by the DCFS 22 and for providing timing signals to the DCFS 22, the transmitter 20, the receiver 24 and the antenna switch 26 for determining the time for transmission and reception of the interrogation and response signals respectively. As further shown in FIG. 3, the controller 40 includes a digital signal processor (DSP) 52 for executing the principal control and computational tasks of the controller 40. The controller 40 also includes a programmable read only memory (PROM) 50 for storing a computer program and table data, a random access memory (RAM) 54 for storing temporary data and a programmable logic device (PLD) 56 for interfacing the controller 40 to the DCFS 22, the transmitter 20, the receiver 24 and the antenna switch 26. The controller 40 further includes an analog-to-digital converter 58 for accepting the (analog) output signal from the receiver 24, converting the output signal from the receiver 24 into a digital representation and inputting the digital representation of the output signal from the receiver 24 into the controller 40. Additionally, the controller 40 includes an input/output device 60 for interfacing the controller 40 to the annunciator 14 over the alarm signal lines 32 and to other EAS sensors 12 over timing signal lines 42, 44 and blocking signal lines 46, 48.

The DSP 52 executes a program stored in the PROM 50 to generate command signals responsive to parameters also stored in the PROM 50. The PLD 56 generates control signals for tuning the DCFS 22 to the correct transmitting and receiving frequencies based upon the command signals received from the DSP 52 and activates the transmitter 20 and the receiver 24 during the transmission and reception time periods. As will be appreciated by those skilled in the art, the structure of the controller 40 is not limited to that disclosed in FIG. 3. For example, microprocessor chips or a single microchip, including software for implementing the function of some or all of the separate components shown in FIG. 3, would be suitable for use in the controller 40. Likewise, different storage devices and interface devices could be used, and still be within the spirit and scope of the invention.

The preferred embodiment the EAS sensor 12 employs a technique known to those skilled in the art as the pulse-listen technique, typified by the Strata™ System, manufactured by Checkpoint Systems, Inc. of Thorofare, N.J. for detecting and localizing a resonant security tag 13 to a specific portion of the security zone 11. In the preferred embodiment of the EAS sensor 12, the transmitter 20 generates an interrogation signal comprising a repeating sequence of discrete frequency, burst type RF signals over a range of RF frequencies, such that the RF frequency of at least one burst falls near the resonant frequency of the resonant security tag 13 to be detected. During quiescent periods between the RF bursts, the receiver 24 receives a response signal re-radiated from the resonant security tag 13 as a result of a resonant circuit in the security tag 13 interacting with the preceding RF burst.

In the preferred embodiment, the antenna switch 26 sequentially selects pair-wise permutations, with replacement, of the antennas 17 connected to each EAS sensor 12 such that for each selected pair of antennas 17, one antenna transmits the interrogation signal and one antenna 17 receives the response signal and each permutation of the pair of antennas 17 is selected only once over a predetermined time interval. The amplitude of the output of the receiver 24 resulting from each permutation of the pairs of antennas 17 is compared in the DSP 52 for each frequency generated by the DCFS 22. The location of the security tag 13 is determined to correspond with the portion of the security zone 11 in the closest proximity to the pair of antennas 17 having the output signal of the receiver 24 with the largest amplitude.

In the preferred embodiment, the number of permutations with replacement, of the antennas 17, is computed by the formula $n^k$, where n is the number of antennas connected to an EAS sensor 12, and k is the number of antennas to be selected for each permutation. Thus, in the preferred embodiment of the EAS sensor 12-1, for example, comprising two antennas 17-1,1 and 17-1,2 connected to the EAS sensor 12-1, there would be four different pair-wise antenna permutatons. However, as previously indicated, more than two antennas can be connected to an EAS sensor 12. In the case of three antennas connected to eacn EAS sensor 12 there would be nine pair-wise permutations of the antennas 17, for four antennas connected to each EAS sensor 12 there would be 16 pair-wise permutations of the antennas 17, etc. However, as will be appreciated by those skilled in the art, the desired localization capability of the security tag detection and localization system 10 is only negligibly degraded if only adjoining antennas 17 are used for antenna pairs. Accordingly, it is within the spirit and scope of the invention to reduce the number of permutations by selecting only adjacent antennas for each of the pairs of antennas 17.

Figures 4A, 4B, 4C:
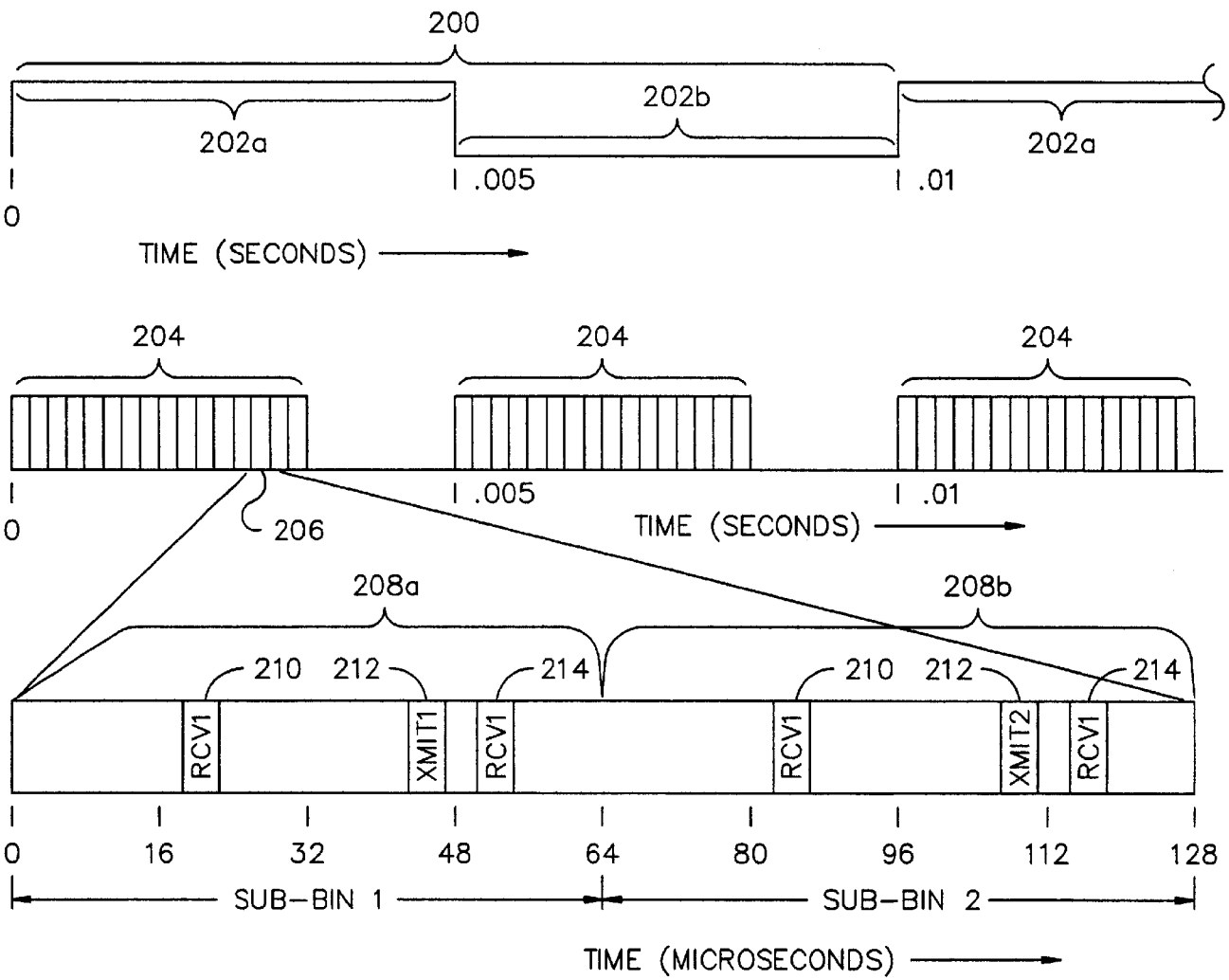
FIGS. 4*a–c* are diagrams illustrative of the various timing signals utilized by the preferred embodiment of the present invention.

As shown in FIGS. 4*a*–4*c*. each EAS sensor 12 operates in accordance with a frame interval. The frame interval 200 (FIG. 4*a*) is divided into as many subframe intervals 202 as there are antennas 17 connected to the EAS sensor 12 for receiving. Within each subframe interval 202 there is a period of transmission and reception 204 consisting of further subdivisions called bins 206 (FIG. 4*b*). Each bin 206 provides for an EAS sensor 12 transmission and reception at a different frequency, the span of frequencies corresponding to the combined frequency uncertainty of the security tag 13 and the EAS sensor 12. As shown in FIG. 4*c*, each bin 206 is further divided into as many sub-bins 208 as there are antennas 17 connected to the EAS sensor 12 for transmitting, with each sub-bin 208 having a noise reception period 210, an interrogation transmission period 212 and a response signal transmission period 214. In the preferred embodiment there are two subframe intervals 202 per frame interval 200, each subframe interval 202 having sixteen bins 206 with two sub-bins 208 per bin 206. In the first subframe interval 202*a*, reception is from antenna 17-1,1 and transmission is from antenna 17-1,1 (phase A) and antenna 17-1,2 (Phase B). In the second subframe interval 202*b*, reception is from antenna 17-1,2 and transmission is from antennas 17-1,1 (Phase C) and 17-1,2 (Phase D).

Referring now to FIG. 2, the antenna 17 connections for one frame 200 of transmission and reception for the preferred embodiment of the security tag detection and localization system 10 consisting of three EAS sensors 12 are shown in Table I.

TABLE I

| | EAS #1 | | EAS #2 | | EAS #3 | |
|---|---|---|---|---|---|---|
| | TX Ant. | RX Ant. | TX Ant. | RX Ant. | TX Ant. | RX Ant. |
| Phase A | 1, 1 | 1, 1 | 2, 1 | 2, 1 | 3, 1 | 3, 1 |
| Phase B | 1, 2 | 1, 1 | 2, 2 | 2, 1 | 3, 2 | 3, 1 |
| Phase C | 1, 1 | 1, 2 | 2, 1 | 2, 2 | 3, 1 | 3, 2 |
| Phase D | 1, 2 | 1, 2 | 2, 2 | 2, 2 | 3, 2 | 3, 2 |

As indicated above, the number of antennas 17 that may be connected to each EAS sensor 12 may be greater than two. As will be appreciated by those skilled in the art, if more than two antennas 17 are connected to the EAS sensor 12, the number of subframes and the number of sub-bins are increased according to the number of the receiving and the transmitting antennas respectively. Accordingly, EAS sensors 12 having a greater number of subframes per frame and sub-bins per bin than two are within the spirit and scope of the invention.

As will be appreciated by those skilled in the art, the Security Tag Detection and Localization System 10 is not limited to employing the pulse-listen technique. For example, the well known EAS technique whereby the EAS sensor 10 sweeps the transmission frequency over the RF band of interest, either continuously or in discrete steps, could also be employed, within the spirit and scope of the invention.

Also shown in FIG. 3 are RF signal input and output lines 34, 36, timing signal input and output lines 42, 44 and blocking signal input and output lines 46, 48 interconnecting the EAS sensors 12, corresponding collectively to the slave signal line 30 shown in FIG. 2. In the preferred embodiment, the method for interconnecting the EAS sensors 12 is by daisy-chaining the RF signal lines 34, 36, the timing signal lines 42, 44 and the blocking signal lines 34, 36 between the separate EAS sensors 12. However, as will be appreciated by those skilled in the art, any type of interconnection method, such as bus type methods, is within the spirit and scope of the invention.

In the preferred embodiment, one EAS sensor 12 is arbitrarily selected as a master for distributing the RF carrier output signal from the DCFS 22 to all the other EAS sensors 12, hereinafter called slave EAS sensors 12. Accordingly, the RF carrier output signal ofthe DCFS 22 is provided over RF output signal line 34 to the input line 36 of a slave EAS sensor 12. The slave EAS sensor 12 provides the received RF carrier output signal to the transmitter 20 and receiver 24 and also outputs the received RF carrier signal to another slave EAS sensor 12. In this manner, the transmitted interrogation signals for every EAS sensor 12 are maintained to be substantially in-phase with each other. Similarly, the master EAS sensor 12 provides timing signals for the frame 200, subframe 202, bin 206, sub-bin 208 and transmitting and receiving periods 210, 212, 214. The aforementioned timing signals originate in PLD 56, are distributed from the master EAS sensor 12 to the slave EAS sensors 12 such that the frames 200, subframes 202, bins 206, sub-bins 208 and transmitting and receiving periods 210, 212, 214 of all the EAS sensors 12 are synchronized.

In the preferred embodiment, the receiver 24 in each EAS sensor 12 generates the received output signal corresponding to the amplitude of the response signal received by the receiver 24 for each permutation of the antennas 17 connected to the EAS sensor 12 and for each frequency generated by the DCFS 22 during each frame interval 200. The receiver output signal is received by the analog-to-digital converter 58 and provided to the DSP 52. For each frequency, the DSP 52 generates a detection signal corresponding to the largest receiver output signal, Sm, for each permutation of the antennas 17 for which the receiver output signal, So, exceeds a predetermined detection threshold, Td, for a predetermined number, Nd, of frame intervals 200, signifying a valid detection of a security tag 13 in at least one detection zone 18. The DSP 52 includes an arbitrator 53 which arbitrates between the detection signal generated by the EAS sensor 12, and a blocking signal having a predetermined duration, Tb, generated by another EAS sensor 12. The arbitrator generates an alarm signal and the blocking signal if the detection signal is received by the arbitrator at a time when the blocking signal is not present. Thus, the arbitrator blocks the alarm of a second occurring detection by another EAS sensor 12 for the duration of the blocking signal. In the preferred embodiment, the duration of the blocking signal is about three seconds. It will be appreciated by those skilled in the art that the duration of the blocking signal is dictated by the particular configuration of the security tag detection and localization system 10 and may be other than about three seconds within the spirit and scope of the invention.

Figure 5:
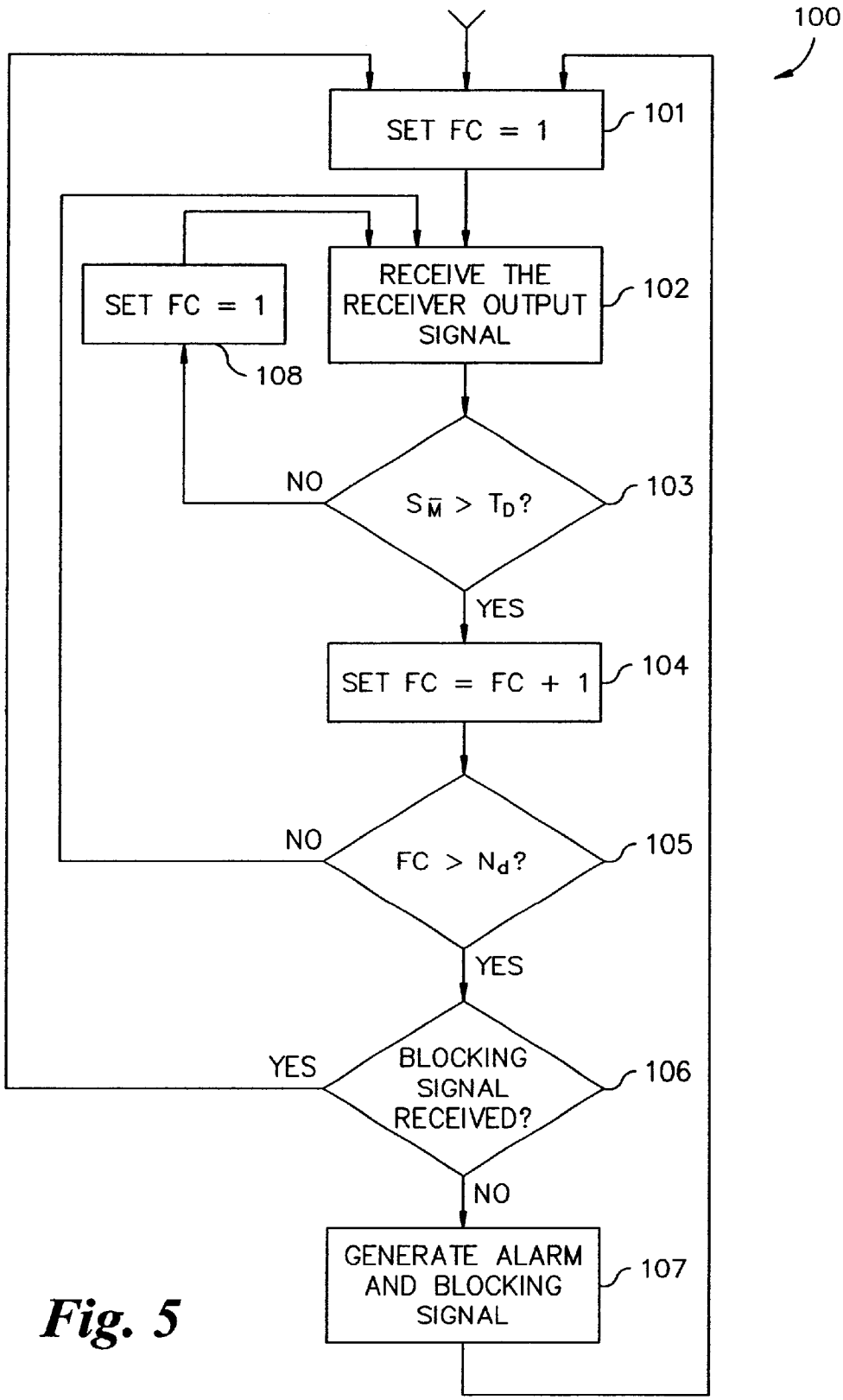
FIG. 5 is a flow diagram describing the process for generating an alarm.

Referring now to FIG. 5, the process for arbitration 100 of the preferred embodiment is shown comprising first setting a frame counter, FC, equal to a value of one (step 101) and receiving the output signal from the receiver 24 into the DSP 52 at step 102. For each frequency, the largest output signal, Sm, from the receiver 24 is compared against the predetermined detection threshold, Td, step 103. If the magnitude of the largest receiver output signal, Sm, exceeds the threshold value Td, the frame counter is advanced by one (step 104) and the value of the frame counter is compared to a predetermined duration, Nd, at step 105. If the largest receiver output signal, Sm, has remained above the threshold, Td, for Nd frame intervals, the arbitration process 100 determines if a blocking signal has been received (step 106). If a blocking signal from another EAS sensor 12 has not been received, the alarm signal and the blocking signal of duration, Tb, are generated at step 107, thereby blocking any alarms from other EAS sensors 12 for the duration of the blocking signal duration. If at step 103, the output of the receiver 24 fails to satisfy the threshold criteria, Td, the frame counter is reset to a value of one. If at step 106, the blocking signal is active when the output of the receiver satisfies the criteria at step 104, thereby preventing a new alarm for the duration of the blocking signal, the frame counter, FC, is reset to a value of one before comparing additional outputs from the receiver 24 with the detection threshold Td.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A security tag detection and localization system for detecting a resonant security tag in a security zone comprising a plurality of detection zones, and generating an alarm signal localizing the resonant security tag to one of the detection zones, the system comprising:

an antenna array for radiating interrogation signals and receiving response signals, the antenna array forming at least one of an upper and a lower boundary of the security zone and being arranged horizontally across a width and a length of the security zone, wherein the antenna array comprises at least two antennas, the at least two antennas forming one of the upper and lower boundaries being disposed side-by-side in a single horizontal plane, each antenna being electromagnetically coupled to one of the detection zones;

at least one electronic article security (EAS) sensor for transmitting interrogation signals to the antenna array, receiving response signals from the antenna array and generating a detection signal in response to the tag being in the security zone;

an arbitrator connected to the at least one EAS sensor for receiving the detection signal from the at least one EAS sensor, the arbitrator generating an alarm signal localizing the tag to the one of the plurality of detection zones based on the first received detection signal; and an annunciator connected to each EAS sensor, for receiving the alarm signal and indicating the detection zone corresponding to the alarm.

2. A security tag detection and localization system according to claim 1 wherein each antenna is a combined transmitting and receiving antenna.

3. A security tag detection and localization system according to claim 1 wherein the antenna array comprises separate transmitting and receiving antennas.

4. A security tag detection and localization system according to claim 1, wherein the antenna array is mounted below the security zone.

5. A security tag detection and localization system according to claim 1, wherein the antenna array is mounted above the security zone.

6. A security tag detection and localization system according to claim 1, wherein the sensor is a pulse-listen type of EAS sensor.

7. A security tag detection and localization system according to claim 6, wherein the EAS sensor further includes an antenna switch for connecting the EAS sensor to a subset of the antennas in the antenna array.

8. A security tag detection and localization system according to claim 7 wherein the antenna switch sequentially selects pair-wise permutations, with replacement, of the subset of antennas connected to the EAS sensor such that for each selected pair, one antenna is for transmitting the interrogation signal and one antenna is for receiving the response signal and each permutation of the antennas is selected only once over a predetermined time interval.

9. A security tag detection and localization system according to claim 8, wherein the antennas in each pair are selected only from adjacent antennas.

10. A security tag detection and localization system according to claim 7, wherein the subset of antennas comprises only two antennas.

11. A security tag detection and localization system according to claim 10 wherein the antenna switch sequentially selects pair-wise permutations, with replacement, of the antennas such that for each selected pair, one antenna is for transmitting the interrogation signal and one antenna is for receiving the response signal and each permutation of the antennas is selected only once over a predetermined time interval.

12. A security tag detection and localization system according to claim 1, wherein the sensor is a swept frequency type of EAS sensor.

13. A security tag detection and localization system according to claim 12, wherein the EAS sensor further includes an antenna switch for connecting the EAS sensor to a subset of the antennas in the antenna array.

14. A security tag detection and localization system according to claim 13 wherein the antenna switch sequentially selects pair-wise permutations, with replacement, of the subset of antennas connected to the EAS sensor such that for each selected pair, one antenna is for transmitting the interrogation signal and one antenna is for receiving the response signal and each permutation of the antennas is selected only once over a predetermined time interval.

15. A security tag detection anid localization system according to claim 14, wherein the antennas in each pair are selected only from adjacent antennas.

16. A security tag detection and localization system according to claim 13, wherein the subset of antennas comprises only two antennas.

17. A security tag detection and localization system according to claim 16, wherein the antenna switch sequentially selects pair-wise permutations, with replacement, of the antennas such that for each selected pair, one antenna is for transmitting the interrogation signal and one antenna is for receiving the response signal and each permutation of the antennas is selected only once over a predetermined time interval.

18. A security tag detection and localization system according to claim 1, wherein each EAS sensor further includes an arbitrator, the arbitrator receiving a detection signal from the EAS sensor and a blocking signal from another EAS sensor, and generating the alarm signal if the detection signal is received at a time when the blocking signal is not received.

19. An EAS sensor of the pulse-listen type for detecting and localizing a resonant security tag to a specific portion of a security zone comprising:

a transmitter for generating an interrogation signal;

a receiver for receiving a response signal from the security tag;

a plurality of transmitting antennas for receiving the interrogation signal from the transmitter and radiating the interrogation signal into the security zone;

a plurality of receiving antennas for receiving the response signal from the security tag and providing the response signal to the receiver, the response signal being a result of the interrogation signal interacting with the security tag and being re-radiated from the security tag; and an antenna switch connecting the transmitter to the transmitting antennas and the receiver to the receiving antennas, the antenna switch sequentially selecting pair-wise permutations, with replacement, of the antennas once over a predetermined time interval, such that each selected pair consists of one transmitting antenna and one receiving antenna, wherein an amplitude of an output from the receiver resulting from each permutation of the antennas is compared, thereby determining the location of the security tau to correspond with the portion of the security zone being in closest proximity to the antenna pair having the receiver output signal with the largest amplitude.

20. A security tag detection and localization system according to claim 19, wherein the antennas in each pair are selected only from adjacent antennas.

21. A security tag detection and localization system according to claim 20, wherein the plurality of antennas connected to the EAS sensor comprises two antennas.

* * * * *